United States Patent [19]

Hung

[11] Patent Number: 4,536,050

[45] Date of Patent: Aug. 20, 1985

[54] TELEPHONE MODULAR WALL JACK

[75] Inventor: Peter Hung, Huntington, N.Y.

[73] Assignee: Porta Systems Corp., Syosset, N.Y.

[21] Appl. No.: 569,194

[22] Filed: Jan. 9, 1984

[51] Int. Cl.[3] ..... H01R 13/39

[52] U.S. Cl. ..... 339/99 R; 339/125 R

[58] Field of Search ..... 339/97 R, 97 P, 98, 339/99 R, 125 R

[56] References Cited

U.S. PATENT DOCUMENTS

| | | | |
|---|---|---|---|
| 4,150,867 | 4/1979 | Knickerbocker | 339/97 P |
| 4,169,220 | 9/1979 | Fields | 179/175.3 R |
| 4,392,701 | 7/1983 | Weidler | 339/97 R |

*Primary Examiner*—Joseph H. McGlynn
*Attorney, Agent, or Firm*—Charles E. Temko

[57] ABSTRACT

An improved telephone modular wall jack particlarly suitable for subscriber installation within the home or other subscriber premises. The jack includes a fixed mounting element slidably engageable with a housing element containing means for stripping insulation from conductors and interconnecting them without the use of tools or special skills. The interconnection of conductors can be accomplished while the housing is in detached condition from the mounting element, following which the housing is attached to the mounting element for installation upon a wall.

1 Claim, 3 Drawing Figures

TELEPHONE MODULAR WALL JACK

BACKGROUND OF THE INVENTION

This invention relates generally to the field of telephony, and more particularly to an improved form of modular wall jack for providing connection between a subscriber pair and a subscriber-owned hand set or other equipment.

In recent years there has been the initiation of regulartory policy encouraging subscriber ownership of on-premises equipment. Such equipment is now readily available from a variety of sources, the equipment being both replicative of original equipment, and available in forms which offer previously unavailable conveniences.

With the innovation by Western Electric Company of the RJ 11 Coupling, the interconnection of such equipment presently requires only a simple plugging-in operation on the part of the subscriber, assuming that a corresponding wall jack is available. Very often this is not the case, and it becomes necessary to provide not only the jack itself in surface mounted form, but the physical interconnections of wiring from the subscriber equipment to the corresponding subscriber pair. Using known type wall jacks, the operation requires not only the stripping and interconnection of the wires to screw terminals, but the performing of this step in an inconvenient location at or near a baseboard located at the lower edge of a building wall. Not all subscribers are possessed of the requisite skill and agility. On the other hand, the calling in of an outside installer can be quite costly.

SUMMARY OF THE INVENTION

Briefly stated, the invention contemplates the provision of an improved modular wall jack construction particularly suited for subscriber installation in which the above-mentioned problems have been substantially eliminated.

The novel structure includes a mounting element of generally planar configuration which may be conveniently securred to a wall baseboard by screw or other mounting hardware, and which is devoid of electrical components.

Selectively attachable to the mounting element is a two part housing which includes a base element slidably attachable to the mounting element after wiring procedures have been completed. The base element includes quick clip type connecting means for stripping wire conductors and mounting them in electrically conductive relation.

Engagable with the base element is a cover element having means on an inner surface thereof for guiding and forcing the conductors into engagement with the quick clip means to complete and maintain the required connections. Means is provided for locking the cover element onto the base element prior to engaging the housing on the mounting element. Thus, it is necessary for the user to move to an uncomfortable position only for the latter operation.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
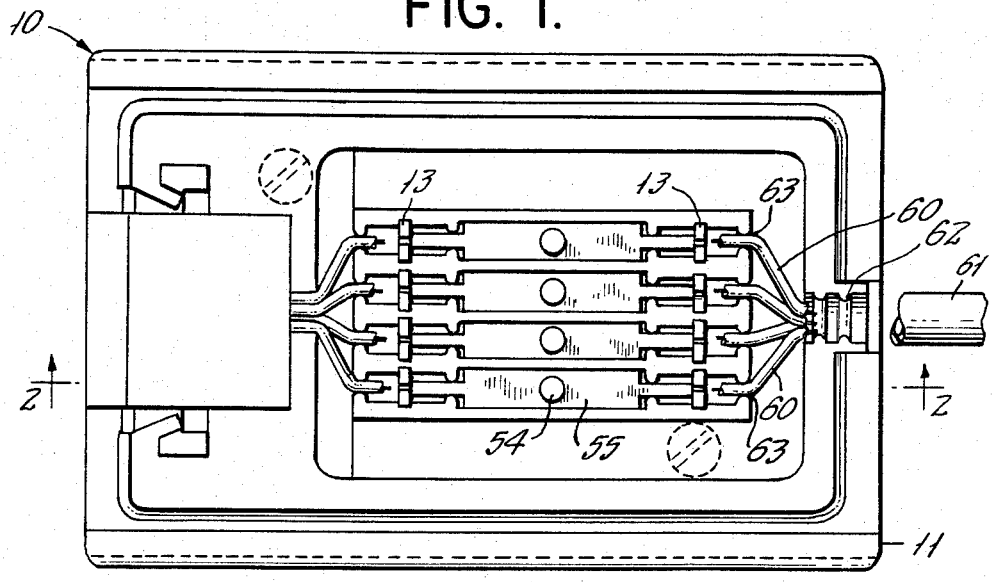
FIG. 1 is a top plan view of an embodiment of the invention with a cover element removed for the purposes of clarity.

In accordance with the invention, the device, generally indicated by reference character 10, comprises broadly: a mounting element 11, and a housing element 12 including a plurality of quick clip connecter elements 13.

The mounting element 11 may be either of molded synthetic resinous construction, or be formed as a continuous metallic extrusion. It includes a planar base wall 21 having a pair of longitudinally oriented laterally extending flanges 22 and 23, the free edges of which have groove-forming terminals 24. The base wall 21 is provided with suitable screw mounting holes 26 wherein the mounting element may be secured to a supporting surface (not shown) in known manner.

The housing element 12 includes a molded insulative base member 30 and a similarly molded cover member 31. The base member 30 is of tapered configuaration, and includes a main transversely extending wall 36 bounded by an upper surface 37, and a lower surface 38. Side walls 39 and 40, and end wall 41 and a medially-disposed wall 42 are molded integrally therewith.

The side walls 39 and 40 are symmetrically positioned, each including an inner surface 46, an outer surface 47, an upper edge surface 48 and a lower edge surface 49. Laterally extending flange portions 50 are dimensioned to frictionally mate with grooves 28 of the terminals 24.

Figure 2:
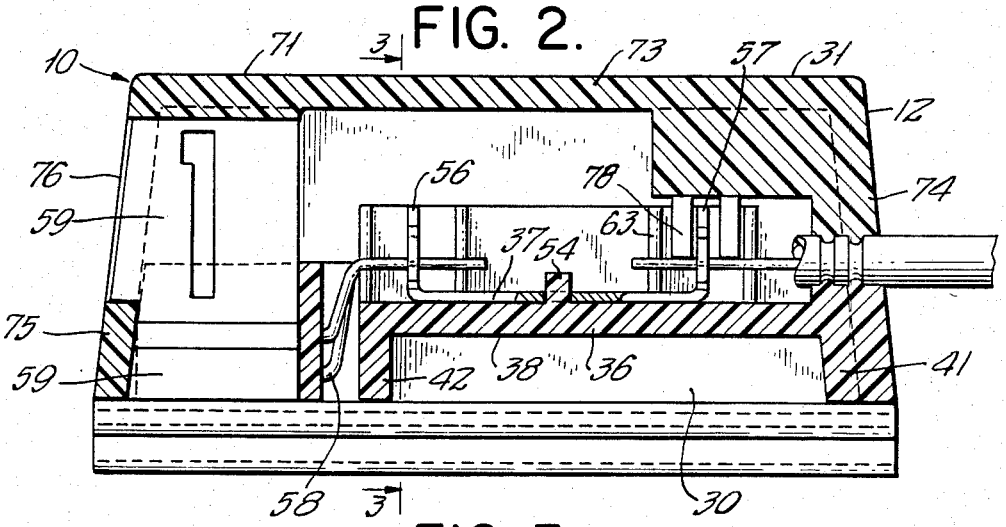
FIG. 2 is a longitudinal central sectional view thereof as seen from the plane 2—2 in FIG. 2.
Figure 3:
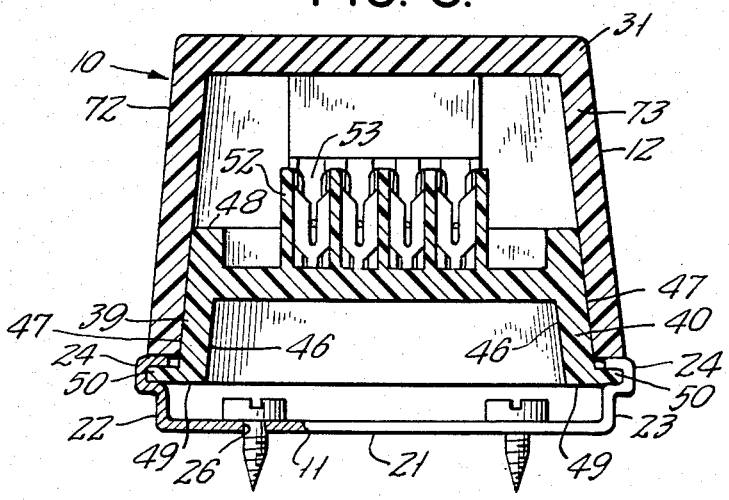
FIG. 3 is a transverse sectional view thereof as seen from the plane 3—3 in FIG. 2.

Extending upwardly from the upper surface 37 are a plurality of spaced mutually parallel septums 52 forming elongated recesses 53 therebetween, each recess being provided with an upwardly extending stud 54 for the pressfit mounting of elongated quick clip elements 55. Each of the elements includes first wire engaging means 56 and second wire engaging means 57. A first set of conductors 58 leads to a recess enclosing a female RJ 11 plug 59. A second set of conductors 60 eminates from a cable 61 to which the wall jack is attached by the subscriber. The cable 61 passes through strain relief means 62, and, as best seen in FIGS. 2 and 3, additional strain relief means 63 is provided for individual conductors which engages the insulative covering thereon (not shown).

The cover member is preferably injection molded from a synthetic resinous insulative material having a degree of resiliency. It includes an outer wall 71, side walls 72 and 73, as well as end walls 74 and 75. The wall 75 is provided with an opening 76 through which a male RJ 11 jack may be inserted to engage the corresponding plug 59. Extending downwardly as seen in FIG. 2, a thickened part of the outer wall 73 mounts projections 78 which cooperate with the quick clip elements 55 in such manner that when the conductors 60 are properly positioned, the closing of the cover member upon the base member serves to push the ends of the conductors into proper engagement with the clip elements 55, again, in known manner.

From my consideration of the drawings, it will be apparent that insulation of the wall jack requires initially the securing of the mounting element 11 to a wall baseboard using wood screws and the like. The housing element 12 may then be separately wired by the subscriber while in a comfortable position, and after the cable conductors 60 have been seated by the pushing of the cover member 31 onto the base member 30, the entire housing element may then be merely slid into engaged condition with the mounting element to be frictionally retained thereby. If desired, small detent means (not shown) may also be used to interconnect the elements 11 and 12, although normally, the frictional engagement of the grooves 28 and the flanges 50 will be adequate.

I wish it to be understood that I do not consider the invention limited to the precise details of structure shown and set forth in this specification, for obvious modifications will occur to those skilled in the art to which the invention pertains.

I claim:

1. An improved telephone modular wall jack comprising: a mounting element of generally planar configuration and having a main wall adapted to be secured to a mounting surface, said mounting element defining a pair of parallel oppositely facing grooves; a housing element including a base member and a cover member, said base member having laterally extending longitudinally oriented flanges slidably engagable with said parallel grooves in said mounting element to be frictionally retained thereby; said base member defining a recess at one end thereof and a plug element disposed in said recess, said base member having elongated quick clip members arranged in mutually parallel relation on a surface thereof, said quick clip members having insulation displacement conductor engaging means on oppositely disposed ends thereof; conductor means interconnecting one end of said clip member with said plug; and said cover member selectively surrounding said base member and having means on an inner surface thereof for engaging second conductors positioned on a second end of said clip members into operative connection therewith as said cover member is pushed into engagement with said base member; whereby said mounting means may be first positioned upon a mounting surface in detached condition, and said housing element may be separately wired and subsequently engaged with said mounting element.

* * * * *